US005617837A

United States Patent [19]

Momirov

[11] Patent Number: 5,617,837

[45] Date of Patent: Apr. 8, 1997

[54] AIR GUN WITH PRESSURE RELIEF VALVE

[75] Inventor: Franz Momirov, Racine, Wis.

[73] Assignee: Crosman Corporation, East Bloomfield, N.Y.

[21] Appl. No.: 243,250

[22] Filed: May 16, 1994

[51] Int. Cl.[6] ..... F41B 11/30

[52] U.S. Cl. ..... 124/73; 124/69

[58] Field of Search ..... 124/56, 63, 69, 124/70, 71, 73; 137/540

[56] References Cited

U.S. PATENT DOCUMENTS

| | | | |
|---|---|---|---|
| 122,756 | 1/1872 | Camerer | 137/540 |
| 1,240,989 | 9/1917 | Lefever | 124/69 |
| 1,404,689 | 1/1922 | Fairweather | 124/69 |
| 1,486,215 | 3/1924 | Zerbee | 124/69 |
| 2,119,441 | 5/1938 | Price | 124/69 |
| 2,299,073 | 10/1942 | Beasley | 124/69 |
| 2,635,599 | 4/1953 | Wells | 124/69 |
| 2,638,884 | 5/1953 | Wells | 124/69 X |
| 3,025,633 | 3/1962 | Kaye et al. . | |
| 3,068,894 | 12/1962 | Bunting . | |
| 3,303,831 | 2/1967 | Sherman . | |
| 3,680,540 | 8/1972 | Stengl . | |
| 3,999,533 | 12/1976 | Buckner | 124/69 |
| 4,091,791 | 5/1978 | Castelli et al. | 124/73 |
| 4,173,964 | 11/1979 | Curran | 124/350 |
| 4,304,213 | 12/1981 | Jereckos | 124/69 |
| 5,224,465 | 6/1993 | Milliman | 124/69 X |
| 5,373,833 | 12/1994 | D'Andrade | 124/69 |
| 5,381,778 | 1/1995 | D'Andrade et al. | 124/69 |

FOREIGN PATENT DOCUMENTS

| | | | |
|---|---|---|---|
| 245601 | 4/1912 | Germany | 124/69 |

*Primary Examiner*—John A. Ricci

[57] ABSTRACT

An air gun includes a pressure relief valve in the pump piston for relieving excess air pressure. The valve is movably mounted on the piston for movement between a closed position in which the valve seals the pressure release opening in the piston and an open position in which air can flow through the pressure relief opening in the piston. A biasing mechanism is also provided for resiliently biasing the valve towards the closed position.

9 Claims, 3 Drawing Sheets

AIR GUN WITH PRESSURE RELIEF VALVE

BACKGROUND

This invention relates to air or pneumatic powered guns, and, more particularly, to a pressure relief valve for an air gun which limits the velocity of projectiles fired by the guns regardless of the number of pumps.

A pneumatic or air powered gun conventionally includes a pressure reservoir for storing pressurized air and firing means for releasing the pressurized air to propel a projectile out of the barrel. Pressure is usually built up in the reservoir by a hand pump mounted on the gun, and the pressure in the reservoir is increased each time the pump is operated. However, variations in the amount of pumping affect the performance of the gun. Excessive muzzle velocity caused by over-pumping may violate government regulations in some jurisdictions. Excessive pressure also causes abnormal wear and damages to components of the gun. Over-pumping can also result in all of the pressure not being released when the gun is fired, and an unexpected discharge might occur without the gun being pumped if the trigger is again pulled. Under-pumping creates a weak muzzle velocity and inaccurate shots.

Pressure relief valves have been employed to control the maximum pressure in guns and other devices. For example, U.S. Pat. Nos. 1,486,215, 3,025,633, 3,680,540, and 4,304,213 disclose valves for shunting air away from the projectile to reduce muzzle velocity when the pressure reaches a certain limit. However, none of the foregoing patents describes a pressure relief valve which is mounted directly within the pump piston.

SUMMARY OF THE INVENTION

The invention mounts a pressure relief valve within the pump piston so that the projectile velocity is accurately controlled regardless of the number of times the piston is pumped. The air pressure is controlled by a spring which engages the valve, and the spring force can be adjusted by a nut which engages the spring. Excess pressure is relieved through an exhaust opening in the side of the piston and the relatively snug fit between the piston and the pump cylinder minimizes surging and loss of too much pressure.

DESCRIPTION OF THE DRAWINGS

The invention will be explained in conjunction with the illustrative embodiment shown in the accompanying drawing, in which.

DESCRIPTION OF SPECIFIC EMBODIMENT

The numeral 10 designates generally an air rifle which includes a frame or receiver 11, a stock 12 secured to the receiver, and a barrel 13 which is mounted on the receiver. The rifle is a conventional air gun with the exception of the piston assembly, and only a brief description of the gun is necessary for an understanding of the invention.

Figure 3:
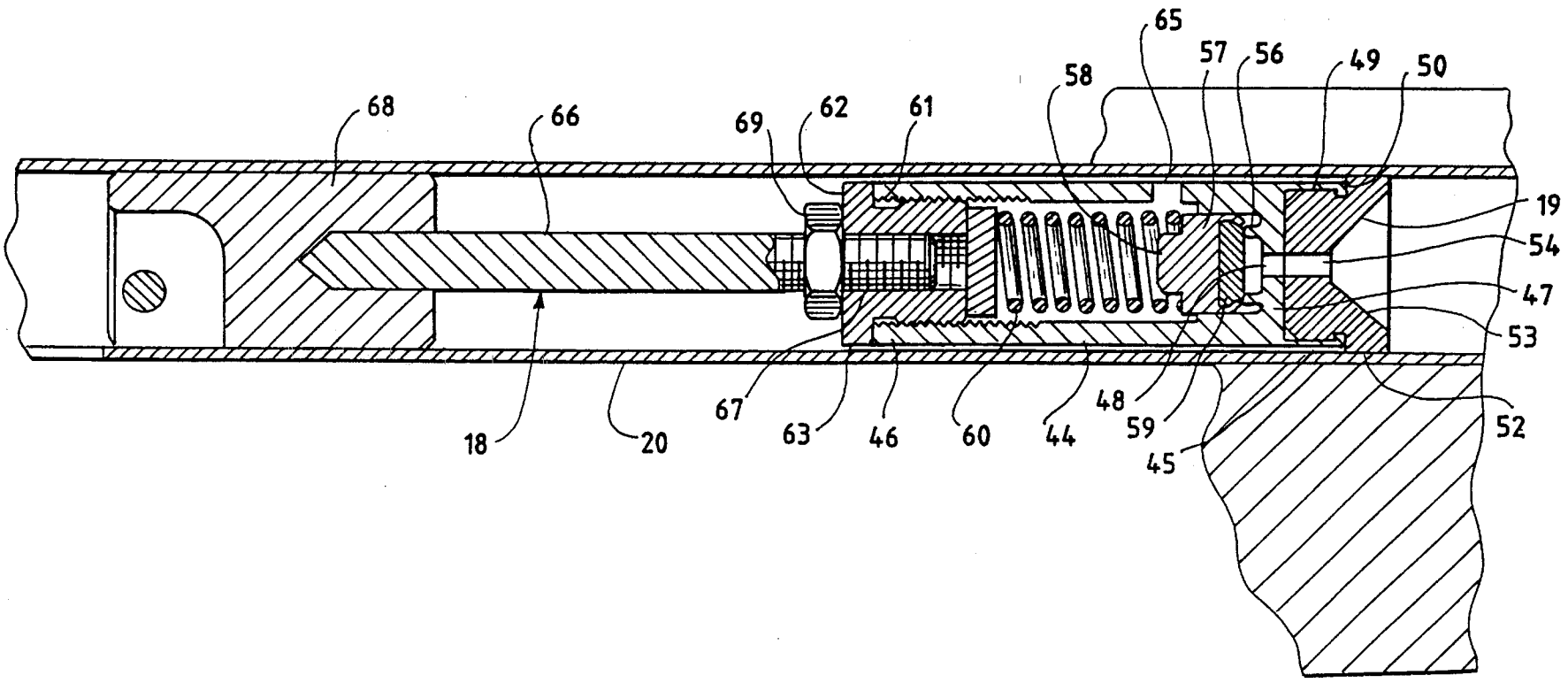
FIG. 3 is an enlarged sectional view of the piston assembly.

Air pressure is built up within the gun by a hand pump assembly 14. A hand grip 15 is pivotally secured to the receiver by a pin 16 and a link 17 is pivotally secured to the hand grip and to a piston assembly 18 (see also FIG. 3). A piston gasket 19 (FIG. 3) of the piston sealingly engages the inside wall of a pump cylinder 20 which is mounted on the receiver.

Figure 1:
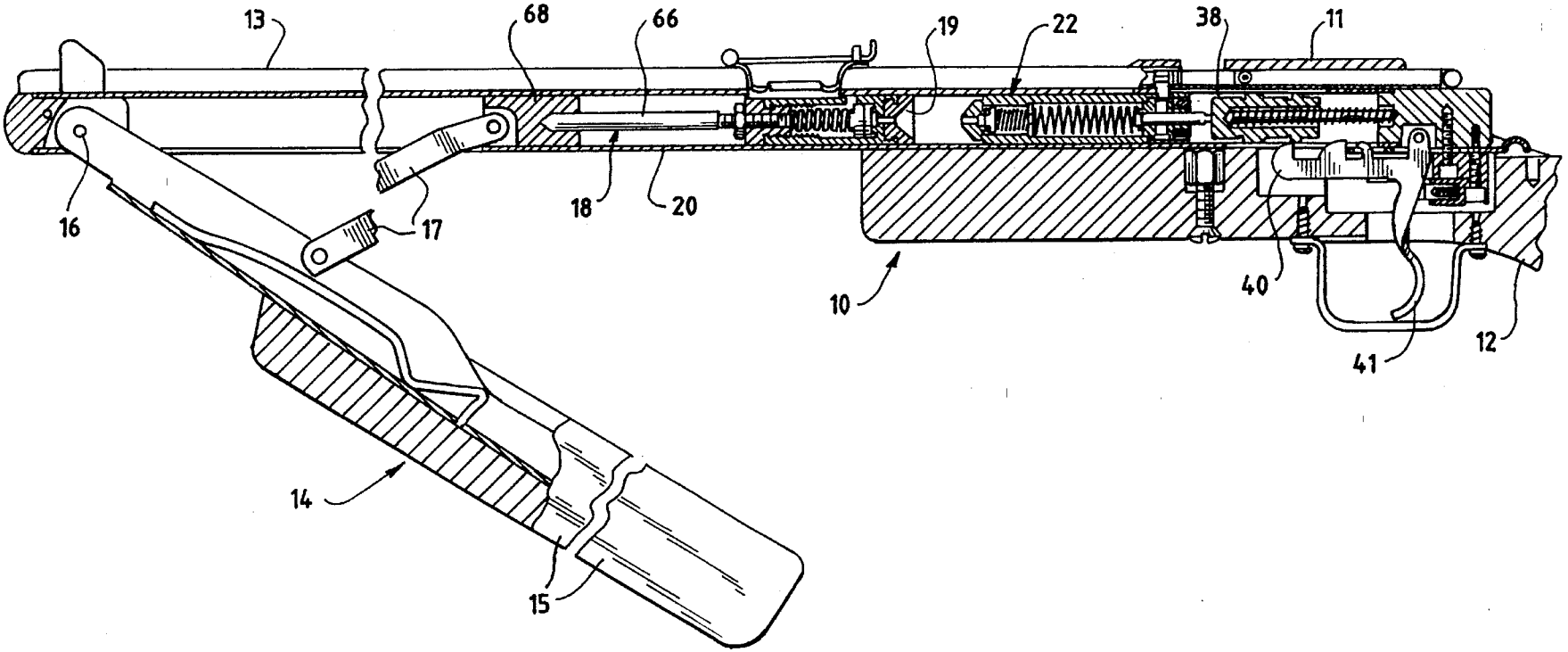
FIG. 1 is a fragmentary sectional view of an air gun which is equipped with a pressure relief valve in accordance with the invention.
Figure 2:
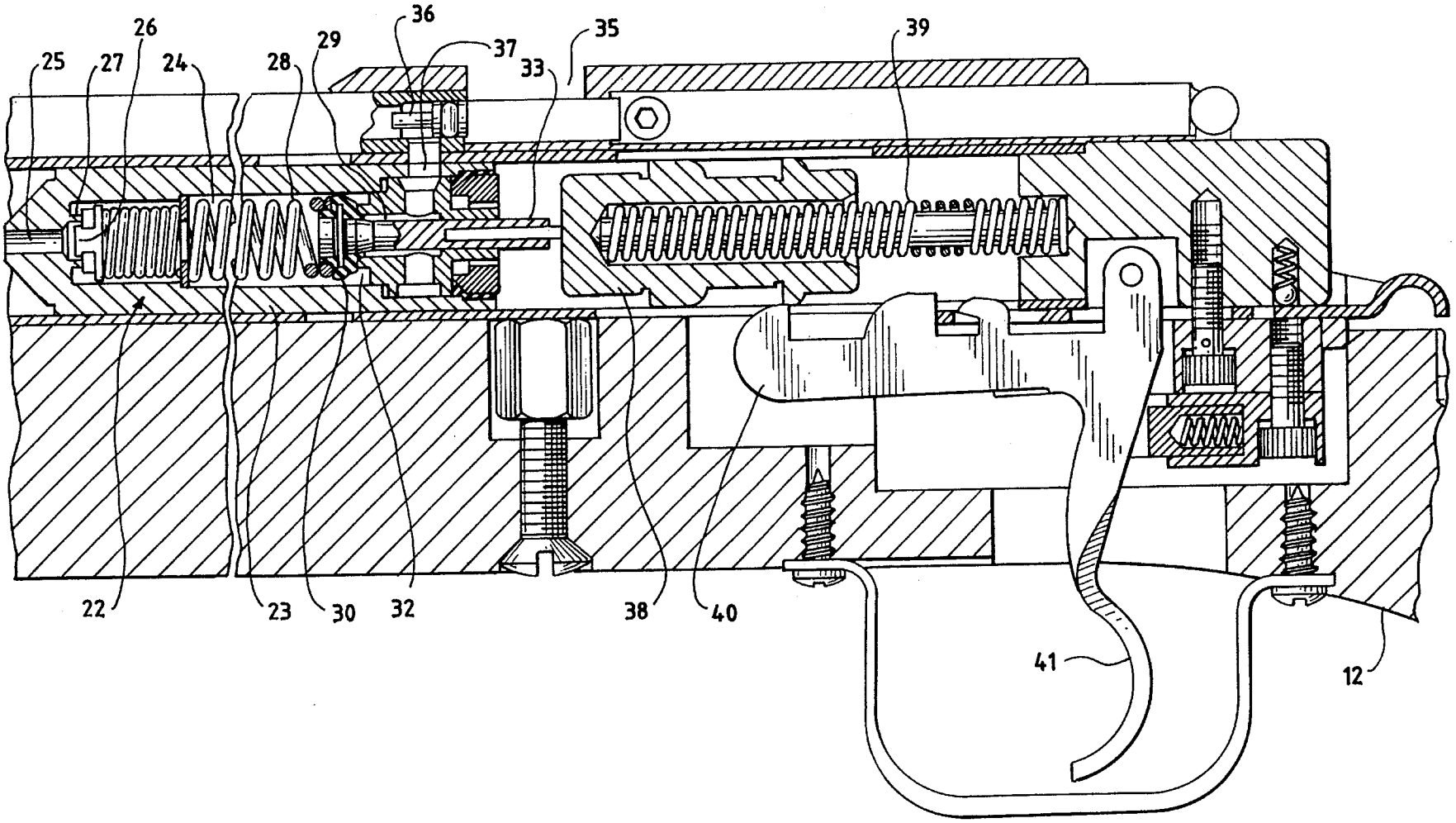
FIG. 2 is an enlarged fragmentary sectional view of a portion of FIG. 1.

A valve assembly 22 (FIG. 2) is mounted in the receiver for storing pressurized air until the gun is fired. The valve assembly includes a valve body 23 which is mounted within the cylinder 20 and which is provided with a pressure reservoir or chamber 24. The end of the valve body which faces the piston 18 is provided with an air inlet 25, and the inlet is normally closed by a plug or plunger 26 which is resiliently biased against an annular seat 27 within the valve body by a spring 28.

A discharge port 29 in the other end of the valve body is normally closed by a valve 30 which is also resiliently biased by the spring 28. The valve 30 engages a valve seat 32 on the valve body and includes a stem 33 which extends through the valve body for engagement by the firing mechanism of the gun.

The reservoir within the valve body 23 is pressurized by reciprocating the piston 18 by pivoting the hand grip 15. Each time the piston is moved toward the valve body, air is compressed by the piston and forced past the plug 26 into the pressure reservoir. The pressure within the reservoir is thereby increased each time the hand grip is pumped.

A projectile such as a pellet can be positioned in the breech end of the barrel through a breech opening 35 in the receiver. A bolt 36 positions the pellet just forwardly of an air port 37 which communicates with the discharge port of the valve body.

The firing mechanism includes a firing hammer or striker 38 which is resiliently biased to the left by a firing spring 39. The hammer is maintained in a cocked position in which it compresses the firing spring by a sear 40. The sear is pivotable by a trigger 41 for releasing the hammer, and the firing spring drives the hammer toward the valve stem 33. When the valve stem 33 is moved to the left, the valve 30 is removed from the valve seat 32, and pressurized air flows from the reservoir through the port 37 to propel the pellet from the barrel.

The structure and operation of the gun as heretofore described is conventional. It will be understood that the velocity at which the pellet or other projectile is fired from the gun depends upon the air pressure within the pressure reservoir when the gun is fired. Each time the pump assembly is pumped, the pressure is increased and the projectile will be fired with greater velocity.

The invention limits the velocity at which the projectile will be fired by limiting the pressure which can be stored within the pressure reservoir. The piston assembly 18 includes a cylindrical body 44 which is reciprocably mounted within the pump cylinder 20. The body includes an inner end 45 which faces toward the valve assembly 22 and an outer end 46. The inner end of the piston body is substantially closed by an end wall 47 which extends perpendicularly to the axis of the piston and which is provided with an axially extending pressure relief opening 48 in the center thereof.

The inner end of the piston body extends slightly beyond the end wall 47 to provide a cylindrical recess 49 into which the piston gasket 19 is inserted. The inner end of the piston body includes a radially inwardly extending flange 50 which extends into an annular groove in the piston gasket 19 for attaching the gasket to the piston body.

The piston gasket is advantageously formed from nylon or other resilient sealing material for sealingly engaging the inside surface of the pump cylinder 20. The gasket includes an outer cylindrical surface 52 which extends slightly radially beyond the outside surface of the piston body, and the piston body does not sealingly engage the pump cylinder 20. A conical recess 53 is provided in the inner end of the piston gasket, and a pressure relief opening 54 extends axially through the piston gasket and is aligned with the pressure relief opening 48 in the piston body.

An annular valve seat 56 on the end wall 47 surrounds the pressure relief opening 48, and the pressure relief opening is normally closed by a pressure relief valve 57. The pressure relief valve includes a cylindrical body 58 and a disc-shaped sealing gasket 59 which is engageable with the valve seat 56. The valve 57 is resiliently biased against the valve seat by a coil spring 60.

The open outer end of the piston body is provided with internal threads 61, and a cylindrical nut 62 is screwed into the piston body. The nut includes a flange 63 which is enageable with the outer end of the piston body to limit inward movement of the nut. The nut engages the outer end of the coil spring 60.

An exhaust opening 65 is provided in the cylindrical wall of the piston body to allow excess air pressure to escape when the pressure relief valve 57 is forced away from the valve seat 56. The excess air flows from the exhaust opening through the gap beween the piston body and the pump cylinder.

A piston rod 66 is screwed into a threaded central opening 67 in the nut 62, and the other end of the piston rod is secured to a cylindrical crosshead 68 which is reciprocably mounted in the pump cylinder 20. The crosshead is pivotally secured to the link 17 so that the piston is reciprocating within the cylinder as the hand pump assembly is operated. A nut 69 on the piston rod is tightened against the nut 62 for retaining the nut 62 in the desired position.

As the piston assembly is moved toward the valve assembly 22 by the hand pump, the piston gasket forces air into the pressure reservoir of the valve assembly. The coil spring 60 normally retains the pressure relief valve 57 closed against the valve seat 56. However, when the pressure within the pressure reservoir is sufficient to overcome the force of the spring, the pressure relief valve is moved away from the valve seat to open the pressure relief openings 48 and 54. The excess air is vented through the exhaust opening 65. Air flow between the piston body 44-and the cylinder 20 is restricted, and surging of the excess air and loss of excessive pressure is thereby minimized.

The closing force exerted on the pressure relief valve by the spring 60 can be adjusted as desired. Maximum inward movement of the nut 62 is set by the stop flange 63. If more firing pressure is desired, one or more spacers are inserted between the nut 62 and the spring 60 to increase the force of the spring. If less firing pressure is desired, material is removed from the threaded end of flange nut 62, thus relieving spring tension.

While in the foregoing specification a detailed description of specific embodiments of the invention was set forth for the purpose of illustration, it will be understood that many of the details herein given may be varied considerably by those skilled in the art without departing from the spirit and scope of the invention.

I claim:

1. An air gun comprising a frame, a barrel mounted on the frame, a valve body mounted on the frame and having a pressure reservoir for storing pressurized air, firing means for releasing pressurized air from the pressure reservoir to the barrel for propelling a projectile out of the barrel, and pump means for supplying pressurized air to the pressure reservoir, the pump means including a cylinder mounted on the frame, a piston reciprocally mounted within the cylinder, means for reciprocating the piston in the cylinder for pumping pressurized air into the pressure reservoir, the piston having a pressure relief opening therethrough, a valve movably mounted on the piston for movement between a closed position in which the valve seals the pressure relief opening in the piston and an open position in which air can flow through the pressure relief opening in the piston, and biasing means for resiliently biasing the valve toward the closed position, the piston including a generally cylindrical body having a cylindrical wall, an inner end, an outer end and an exhaust opening which extends through the cylindrical wall and communicates with a gap between the cylindrical body and the cylinder, said pressure relief opening in the piston being provided through the inner end of the piston, said valve being mounted within the cylindrical body of the piston, said biasing means comprising a spring within the cylindrical body and engaging the valve.

2. The air gun of claim 1 in which the outer end of the cylindrical body is provided with a threaded opening, a nut threaded into the threaded opening, one or more spacers provided on said nut and engaging the spring.

3. The air gun of claim 2 in which said means for reciprocating the piston includes a piston rod attached to said nut and a pump handle attached to the piston rod.

4. The air gun of claim 3 in which said piston rod is threadedly engaged with said nut.

5. The air gun of claim 1 including a gasket mounted on the inner end of the piston for sealingly engaging said cylinder, the gasket having a pressure relief opening which is aligned with the pressure relief opening in the piston.

6. The air gun of claim 1 in which said inner end of the piston includes a valve seat which surrounds the pressure relief valve and which is engageable with said valve.

7. The air gun of claim 6 in which said valve includes a gasket which is sealingly engageable with said valve seat.

8. An air gun comprising a frame, a barrel mounted on the frame, a valve body mounted on the frame and having a pressure reservoir for storing pressurized air, firing means for releasing pressurized air from the pressure reservoir to the barrel for propelling a projectile out of the barrel, and pump means for supplying pressurized air to the pressure reservoir, the pump means including a cylinder mounted on the frame, a piston reciprocally mounted within the cylinder, means for reciprocating the piston in the cylinder for pumping pressurized air into the pressure reservoir, the piston including a cylindrical body having an inner end and an outer end, an end wall substantially closing the inner end of the cylindrical body and having pressure relief openings therethrough, the outer end of the cylindrical body having a threaded opening, a cylindrical gasket mounted on the inner end of the cylindrical body and sealingly engaging said cylinder, said gasket having a pressure relief opening which is aligned with the pressure relief opening in the end wall of the cylindrical body, a valve movably mounted within the cylindrical body for movement between a closed position in which the valve seals the pressure relief opening in the end wall and an open position in which air can flow through the pressure relief opening, a spring within the cylindrical body for resiliently biasing the valve toward the closed position, a nut threaded into the threaded opening in the outer end of the cylindrical body, and one or more spacers provided on the nut and engaging the spring said means for reciprocating the piston including a piston rod attached to said nut and a pump handle attached to the piston rod.

9. The air gun of claim 8 in which said piston rod is threadedly engaged with said nut.

* * * * *